United States Patent [19]

Glaeser

[11] 4,011,999

[45] Mar. 15, 1977

[54] SELF CLEANING TRASH SHREDDER

[75] Inventor: Walter M. Glaeser, Affton, Mo.

[73] Assignee: Williams Patent Crusher and Pulzerizer Company, St. Louis, Mo.

[22] Filed: July 2, 1975

[21] Appl. No.: 592,633

[52] U.S. Cl. ..... 241/79.1; 198/603; 241/186 R; 241/189 R

[51] Int. Cl.[2] ..... B02C 13/286

[58] Field of Search ..... 241/186 R, 186.3, 189 R, 241/189 A, 223, 79.1; 198/76, 84, 603

[56] References Cited

UNITED STATES PATENTS

| | | | |
|---|---|---|---|
| 784,462 | 3/1905 | Yancey | 198/76 X |
| 2,362,677 | 11/1944 | Stephens | 198/76 |
| 2,737,997 | 3/1956 | Himmelheber | 198/84 X |
| 3,540,665 | 11/1970 | Snoek | 241/186 R X |
| 3,667,694 | 6/1972 | Williams | 241/189 A X |
| 3,806,048 | 4/1974 | Williams | 241/189 A |
| 3,857,520 | 12/1974 | Ducasse | 241/189 R |

*Primary Examiner*—Roy Lake
*Assistant Examiner*—Howard N. Goldberg
*Attorney, Agent, or Firm*—Gravely, Lieder & Woodruff

[57] ABSTRACT

Trash shredder having the discharge from the shredder arranged to spread out the shredded trash for later separation of magnetic fractions and also to collect the dirt and remove it from the operating area of the shredder.

5 Claims, 2 Drawing Figures

SELF CLEANING TRASH SHREDDER

BRIEF SUMMARY OF THE INVENTION

The prevailing arrangement of apparatus for shredding and separating magnetic fractions from the total output of trash shredders is to drop the total discharge from the shredder onto a belt or vibratory conveyor which then carries the total discharge in a thick layer to a magnetic separator where the magnetic fractions are extracted while the balance of the trash is moved away in a lateral direction for disposal. This arrangement allows dirt to fall off into the operating area of the shredder, and makes magnetic separation difficult due to the piling effect of the shredded trash which very often has magnetic fractions covered by non-magnetic fractions to a depth sufficient to render the magnetic influence too weak to be effective. Furthermore, the prevailing arrangements use up far too much working area and because of this apparatus cannot be installed in close settings, and complicated conveyor layouts are usually called for which contributes to the cost of installation of apparatus for shredding large quantities of trash.

In a preferred embodiment the trash to be shredded and sorted into magnetic and other fractions includes the arrangement wherein the infeed of trash is directed to the inlet chamber for a reversible or one way hammer mill which shreds the trash to a manageable size before being discharged onto a catcher conveyor which carried the trash down to a discharge end where it falls onto a second or carrier conveyor which runs back under the catcher conveyor and up an incline to a magnetic separation station. The second conveyor extends under the catcher conveyor and is in position to collect the offal or dirt falling from the catcher conveyor. The over-under aligned setting of the catcher conveyor and the carrier conveyor, and the reverse direction of operation of the carrier conveyor makes it possible to maintain a minimum desirable drop off distance between the discharge from the catcher conveyor to the carrier conveyor for adequately spreading and distributing the shredded material as it falls onto the carrier conveyor. In this connection the carrier conveyor is narrower than the catcher conveyor so that sufficient drop distance must be obtained to prevent the material bridging. Furthermore, the infeed conveyor, the catcher conveyor, and the carrier conveyor can all be maintained in a common alignment so that a battery of shredders may be placed side by side so as to conserve the area necessary to accommodate several shredders.

BRIEF DESCRIPTION OF THE DRAWING

A preferred form for the self cleaning trash shredder is shown in the accompanying drawing, wherein.

DETAILED DESCRIPTION OF THE TRASH SHREDDER

Figure 2:
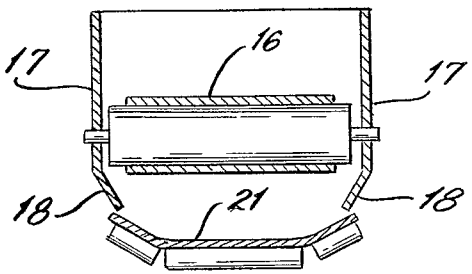
FIG. 2 is a fragmentary section taken at line 2—2 in FIG. 1.

The casing for the shredder 10 is suitably mounted on a platform 11 so to have its trash receiving chamber 12 in free standing position to be connected up to the enclosing hood 13 for the infeed belt conveyor 14. The hood 13 for the infeed conveyor passes over a dribble chute 15 so as to collect and direct small particles that may fall at the place where the infeed conveyor 14 makes its turn to connect up with the chamber 12.

Figure 1:
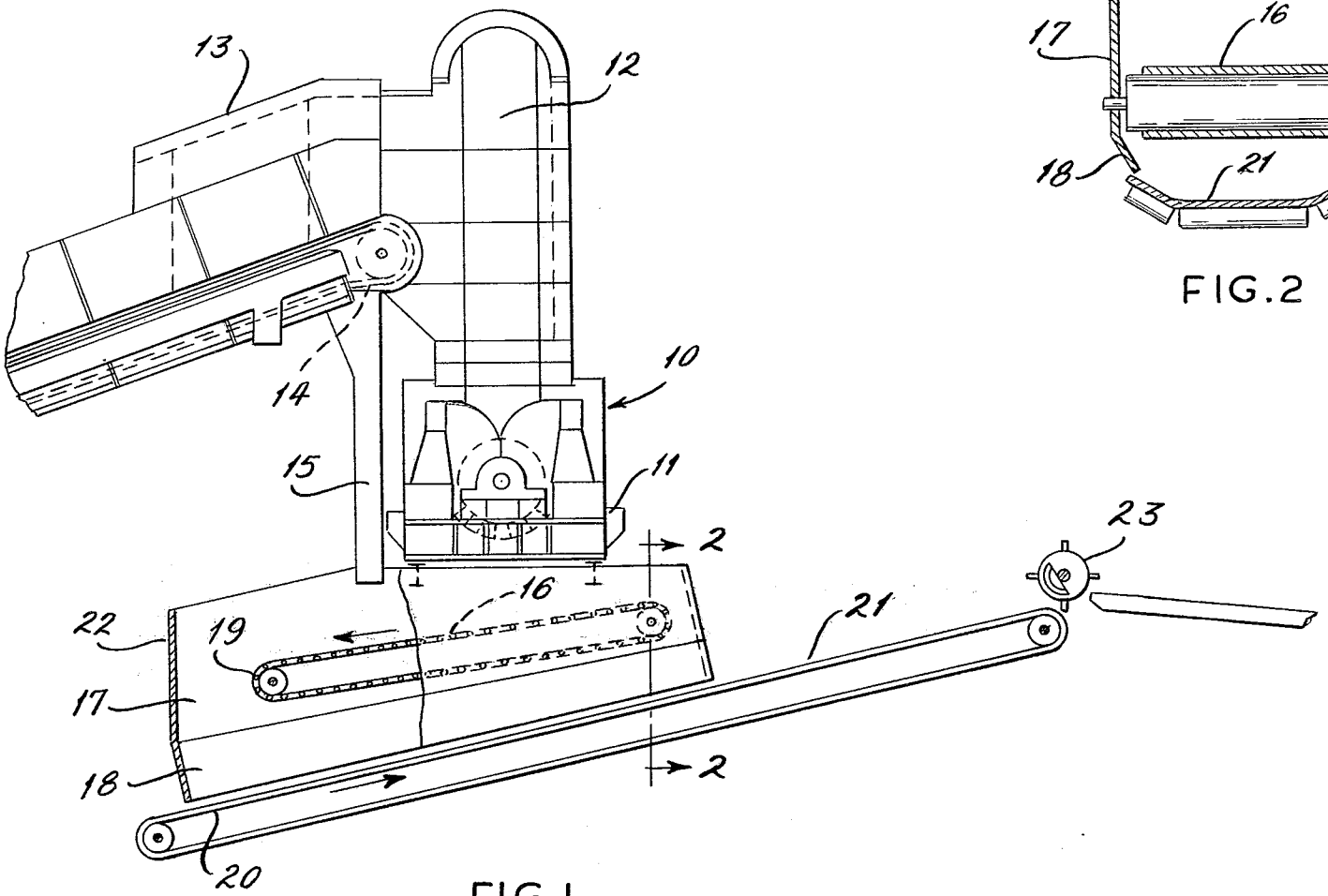
FIG. 1 is a schematic view of the apparatus.

The outlet of the shredder 10 is aligned with a catcher conveyor 16 which is made up of a suitable pan type conveyor belt directed between side walls 17 of an enclosing frame having mold boards 18 (FIG. 2) so as to confine as much as possible the shredded material falling from the outlet of the shredder 10. The pan type conveyor belt 16, as seen in FIG. 1 is composed of a series of pans connected by hinges in a manner well understood in this art. The belt 16 is, therefore, not solid but has spaces at the hinges where the fine trash particles are fully able to sift through. Hence, the side walls 17 enclose that portion of the catcher conveyor belt 16 (See FIGS. 1 and 2) subjected to the initial fall of material from the shredder 10. The conveyor 16 normally has a width comparable with that of the shredder discharge. The conveyor belt 16 runs over a discharge end 19 which is spaced above the receiving end 20 of an upwardly inclined carrier conveyor 21. The side walls 17 and an end wall 22 enclose the carrier conveyor receiving end 20 and forms a hopper into which the shredded material falls, and the slope of the mold boards is such that the material will not pile up and bridge over the conveyor. As the material falls it will maintain a substantially even stream width. As the material falls the mold boards 18 and the angularly elevated margins of the belt conveyor 21 will direct the falling trash into the narrow portion of the conveyor 21 so that the effective material conveying portion of conveyor 21 is narrower than the pan conveyor 16, and the layer of trash approaching the upper end of conveyor 21 will have uniformity of width and depth in view of the difference in relative speeds of conveyors 16 and 21.

The catcher conveyor 16 is directed at an angle of approximately 10° below the horizontal so as to insure rapid and positive removal of the shredded product, while the carrier conveyor 21 is directed at an angle of approximately 16° above the horizontal. The amount of head room or the vertical separation between the discharge end 19 and the receiving end 20 of the respective conveyors is such that the material will fall in a stream having a uniform width. The thinning out of the shredded trash is greatly assisted by running the conveyor 21 at a higher linear speed than the conveyor 16. In a presently preferred embodiment the conveyor 21 was operated at a speed of 400 – 450 feed per minute while conveyor 16 was operated at a speed of 40 – 70 feet per minute. It is also evident from the drawing that the over - under alignment of the conveyors 16 and 21 places the conveyor 21 in a position to collect the dirt which falls through the pans of the conveyor 16, and in this way the conveyor 21 collects the dirt that would otherwise fall on the surface of the working area and create hazardous working conditions.

The carrier conveyor 21 moves the shredded trash and dirt to a magnetic drum separator 23 which works effectively to extract the magnetic fractions of the shredded trash and allows for the efficient disposal of the remainder of the trash. This particular portion of the assembly is only schematically shown as it may have any of several known configurations.

The foregoing description has set forth the important details with respect to the self cleaning trash shredder in which the infeed conveyor 14, the catcher conveyor 16, and the carrier conveyor 21 are assembled in vertical alignment so as to give the assembly a minimum width, whereby a number of similar self cleaning trash shredders may be placed side by side. The shredder 10 has been shown in elevation, but it is understood that the internal shredding mechanism may be of the type disclosed in Williams U.S. Pat. No. 3,667,694, granted June 6, 1972, and the structure of the hammer mill of that patent is incorporated herein by reference.

This disclosure is intended to set forth a presently preferred embodiment of the several components which make up a self cleaning trash shredder, but it is understood that modifications may be made without departing from the general principals set forth herein.

I claim:

1. In trash shredder and conveying apparatus the combination of a trash shredder having a trash receiving inlet and a shredded trash discharge, a first elongated conveyor set at a downward slope to a discharge end and being aligned below said trash discharge to catch the shredded trash and move it to said discharge end, a second elongated conveyor set at an upward slope from a receiving end and being aligned with and extending in the direction of elongation of and spaced vertically below said first conveyor and having said receiving end spaced from said discharge end of said first conveyor, said second conveyor have a higher linear speed than said first conveyor and also a greater slope than the slope of said first conveyor, said conveyors being spaced farthest apart between said discharge end of said first conveyor and the underlying receiving end of said second conveyor, the vertical spacing between said ends of said first and second conveyors being sufficient to spread the shredded trash falling onto said second conveyor and the alignment of said second conveyor below said first conveyor placing said second conveyor in position to collect along a portion of its length the offal of said first conveyor, and means enclosing said first conveyor and at least a portion of said second conveyor to confine trash to said conveyors.

2. Trash shredding and conveying apparatus, comprising in combination: trash shredding means having a trash infeed and a shredded trash discharge below said infeed; a first shredded trash catching conveyor beneath said shredding means discharge and extending therefrom in a linear path inclined to the horizontal to a discharge end; a carrier conveyor extending in a linear direction and aligned beneath said catcher conveyor and inclined to the horizontal from a receiving end to a discharge end; means enclosing both of said conveyors to confine substantially all of the shredded trash to said conveyors and control the transfer of shredded trash from said catcher conveyor discharge end to the receiving end of said carrier conveyor, said enclosing means including mold board means in position adjacent said carrier conveyor to confine to and arrange the shredded trash on said carrier conveyor for movement to the discharge end thereof; and magnetic separator means adjacent the discharge end of said carrier conveyor to separate out magnetic trash from non-magnetic trash.

3. The combination set forth in claim 2 in which said conveyors are inclined at different angles and convey the shredder trash in different directions.

4. The combination set forth in claim 2 in which said conveyors have different linear speeds.

5. The combination set forth in claim 4 in which said carrier conveyor has a higher linear speed.

* * * * *